US008313262B2

(12) United States Patent
Delbove

(10) Patent No.: US 8,313,262 B2
(45) Date of Patent: Nov. 20, 2012

(54) DEVICE FOR PACKAGING AND DELIVERING A STICK OF PRODUCT, NOTABLY A COSMETIC PRODUCT

(75) Inventor: William Delbove, Paris (FR)

(73) Assignee: L'Oreal, Paris (FR)

( * ) Notice: Subject to any disclaimer, the term of this patent is extended or adjusted under 35 U.S.C. 154(b) by 918 days.

(21) Appl. No.: 12/341,610

(22) Filed: Dec. 22, 2008

(65) Prior Publication Data

US 2009/0188513 A1 Jul. 30, 2009

Related U.S. Application Data

(60) Provisional application No. 61/018,546, filed on Jan. 2, 2008.

(30) Foreign Application Priority Data

Dec. 20, 2007 (FR) ..... 07 60132

(51) Int. Cl.
*B43K 24/02* (2006.01)

(52) U.S. Cl. ..... 401/107; 401/75; 401/77; 401/108

(58) Field of Classification Search ..... 401/68, 401/75–78, 107, 108
See application file for complete search history.

(56) References Cited

U.S. PATENT DOCUMENTS

| | | | |
|---|---|---|---|
| 373,241 | A | 11/1887 | Mawhood |
| 2,095,380 | A | 10/1937 | Coryell |
| 2,386,417 | A | 10/1945 | Apfelbaum |
| 5,890,826 | A | 4/1999 | Kim |
| 5,979,468 | A | 11/1999 | Blake, III |

FOREIGN PATENT DOCUMENTS

| | | |
|---|---|---|
| FR | 948 199 | 7/1949 |
| FR | 2 548 880 | 1/1985 |
| GB | 422261 | 1/1935 |
| GB | 616539 | 1/1949 |
| GB | 2 143 212 | 2/1985 |

*Primary Examiner* — Tuan N Nguyen
(74) *Attorney, Agent, or Firm* — Oblon, Spivak, McClelland, Maier & Neustadt, L.L.P.

(57) ABSTRACT

A device for packaging and delivering a product, notably a cosmetic product, is provided with a body, a supporting cup forming a seat for the product and able to move relative to the body between a storage position and at least one position of use of the product, an operator for operating the supporting cup including a guidance sheath, a casing surrounding guidance sheath and a member for operating the cup. The device also includes structure that, in a designated position, prevents the casing from rotating, interacting with the casing and an actuator for actuating the structure.

24 Claims, 12 Drawing Sheets

DEVICE FOR PACKAGING AND DELIVERING A STICK OF PRODUCT, NOTABLY A COSMETIC PRODUCT

CROSS-REFERENCE TO RELATED APPLICATIONS

This document claims priority to French Patent Application No. 07 60132, filed on Dec. 20, 2007 and U.S. Provisional Application No. 61/018,546, filed on Jan. 2, 2008, the entire contents of each of which are hereby incorporated by reference.

FIELD OF THE INVENTION

The present invention relates to the field of devices for packaging and delivering a product. In one example, the product is a cosmetic product.

"Cosmetic product" means a product as defined in Directive 93/35/EEC of the Council of 14 Jun. 1993.

BACKGROUND OF THE INVENTION

Discussion of Background

The present invention relates more particularly to the field of devices for packaging and delivering a stick of product such as a lipstick, a foundation, an eyeshadow, a face powder, a color corrector, a treatment, washing or moisturizing compound, a deodorant, or else a haircare product.

Such sticks are usually packaged in a supporting cup that can be moved inside a body by an operating means in order to allow the stick to travel from a storage position to a position of use of the product, and vice versa. For more detail, it is possible for example to refer to FR-A1-2 548 880 made by the Applicant.

To protect the stick of product when the supporting cup is in the storage position, it is possible to use a closure cap fitted to the body.

Alternatively, it is possible to provide a flap for the closure of an orifice for the outlet of the product that can be moved inside the body as is described in U.S. Pat. No. 5,890,826. The device of this document comprises a sheath for the guidance of the supporting cup and a sleeve surrounding the sheath which is provided with a helical groove capable of interacting with a lug of the closure flap in order to obtain a simultaneous movement of the cup and the flap when the device is actuated.

Therefore, in this document, the movement of the stick of product and the operation of the closure flap are carried out simultaneously and are produced by a hand operation of normal use relative to a conventional packaging device with a closure cap.

Similarly, U.S. Pat. No. 2,386,417 describes a device for the packaging and the delivering of a stick of product comprising a cup for supporting said stick that can be moved inside an inner casing mounted inside an intermediate casing, itself placed in an outer casing. The device also comprises closure flaps that may be moved when the intermediate casing is rotated.

The device also comprises an operating member attached to the cup for supporting the stick and suitable to allow the flaps to be opened and the cup to be moved. Specifically, when the user moves the operating member, there is initially a joint movement of the supporting cup and a rotation of the intermediate casing causing the closure flaps to open. Then, by vertical sliding of the operating member in a groove of the intermediate casing, the upward movement of the supporting cup continues.

Therefore, with this device, in order to move the closure flaps, it is necessary first to obtain a movement of the cup for supporting the stick. Specifically, a single operating member is provided to carry out both the operation of the supporting cup and the opening of the closure flaps. Furthermore, with such a device, the supporting cup can be unstable in the position of use of the stick.

Also described, in FR 948 199, is a lipstick tube comprising a body furnished with means for operating a cup for supporting the lipstick, and a side window arranged in said body to make it possible, when a sliding flap has been moved, to have access to the operating means.

In FR 948 199, to allow an application of the lipstick, it is therefore necessary to move the flap, then actuate the means for operating the supporting cup.

The disadvantage of this device is that it does not allow for the means for operating the supporting cup to be locked until the closure flap has entirely left free an orifice for the outlet of the lipstick. Therefore, when the supporting cup is moved for the purpose of applying the stick of cosmetic, the latter may butt against the flap which may cause damage and even a breakage of the stick.

More generally, the above-noted device does not provide the possibility of locking the axial movement of the supporting cup in a position of use of the stick, or else in a position of storage.

SUMMARY OF THE INVENTION

Examples of the present invention therefore aim to ameliorate one or more of the issues noted above.

More particularly, one object of certain examples of the present invention is to provide a device for packaging and delivering a product making it possible to lock a possible axial movement of the cup supporting the stick.

A further object of certain examples of the invention is to provide a device allowing a movement of said product from a storage position to a position of use, and vice versa, in a particularly secure manner.

One aspect of the invention therefore provides a device for packaging and delivering a product, notably a cosmetic product, provided with a body, a supporting cup forming a seat for the product and able to move relative to the body between a storage position and at least one position of use of the product. This aspect includes means for operating the supporting cup comprising a guidance sheath, a casing surrounding said guidance sheath and an operating member capable of rotating said casing in order to obtain the axial movement of the supporting cup inside the guidance sheath.

According to one aspect of the invention, the device also comprises means for preventing the rotation of the casing interacting with said casing and a means for actuating the antirotation means.

Therefore, it is possible to obtain the locking in position of the supporting cup and of the stick in one or more predetermined positions.

In this aspect, the means for preventing the casing from rotating are distinct from the operating member allowing the axial movement of the cup.

The antirotation means are preferably connected to or secured to the casing in the storage position and in the position of use of the product.

Advantageously, the antirotation means are arranged partly on the outer surface of the casing.

Preferably, the antirotation means are capable of guiding the actuation means along at least two paths of different direction.

In one embodiment, the antirotation means are capable of guiding the actuation means along at least one translation path. The translation path advantageously extends along an axis parallel to an axis secant to an orifice for the outlet of the product.

Advantageously, the device may also comprise a means for guiding the actuation means along at least one rotation path.

In one embodiment, the antirotation means comprise at least a first groove extending axially along the outer surface of the casing, while considering an axis secant to an orifice for the outlet of the product, and a lug capable of interacting with the first groove in order to prevent the casing from rotating.

The casing may comprise a second groove connecting to the first groove and extending over the outer surface of the casing about the axis, said second groove being capable of allowing the casing to rotate relative to the lug.

In one embodiment, the second groove extends circumferentially over the outer surface of the casing in an angular range from 345° to 355°, and preferably equal to 350°. Alternatively, the second groove extends helically over the outer surface of the casing.

Advantageously, the device may comprise a means, such as a lid or flap, for closing off an orifice for the outlet of the product that can be moved between a position of closure of the outlet orifice and an open position. The closure means may be secured to the actuation means. The antirotation means preferably allow the closure means to be guided between the closed position of the outlet orifice and the open position.

The first groove and the lug interact to obtain the movement of the closure means between the closed position of the outlet orifice and the open position. The second groove is capable of allowing a rotation of the casing relative to the lug once the closure means is in the open position, for the purpose of the movement of the supporting cup between the storage position and the position or positions of use of the product.

Therefore, the lug and the first groove made on the outer surface of the casing form a means of preventing the casing from rotating in order to prevent a possible axial movement of the cup until the closure means leaves free the outlet orifice. Specifically, the rotation of the casing relative to the actuation means is allowed only when the lug is housed in the second groove which is directly connected to the first groove.

In other words, the grooves made on the casing which surrounds the guidance sheath inside which the supporting cup moves make it possible to obtain successively the movement of the closure means and then that of the supporting cup, or vice versa. This is obtained by two distinct grooves.

Therefore, the cup supporting the stick may be moved in the direction of the outlet orifice only when said orifice is left entirely free or open by the closure means, which makes it possible to reduce the risk of contact between the stick and the closure means. This is obtained by providing two distinct and successive movements for the movement of the closure means and of the stick. The device therefore uses a double hand movement.

In addition, to view the color of the stick of product, it is possible to move the closure means without having to actuate the operating member to have said stick rise.

In one embodiment, the actuation means comprise a slide provided with a flexible tongue on which the antirotation means are partly provided.

Preferably, the actuation means comprise a button that can be accessed from the outside of the body and that is furnished with attachment capable of allowing the button to be mounted on the slide. In one embodiment, the body comprises a polygonal transverse section, notably square or rectangular, and the button extends at least partly over two faces of the polygon.

The operating member can be accessed permanently in the storage position and in the position of use of the product.

One embodiment of the invention relates to a makeup method wherein the user applies a cosmetic product mounted on a supporting cup that can be moved in a casing between a storage position and at least one position of use, and locks the movement of the cup in the position or positions of use via an actuator that prevents the casing from rotating.

In one embodiment, the user allows the movement of the cup from the storage position to the position or positions of use only after a lid or flap of an orifice for the outlet of the cosmetic product has been moved to leave said outlet orifice open.

As should be apparent, the various examples of invention can provide a number of advantageous features, benefits, or objects. It is to be understood that, in practicing the invention, an embodiment can be constructed to include one or more features or benefits or objects of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE INVENTION

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
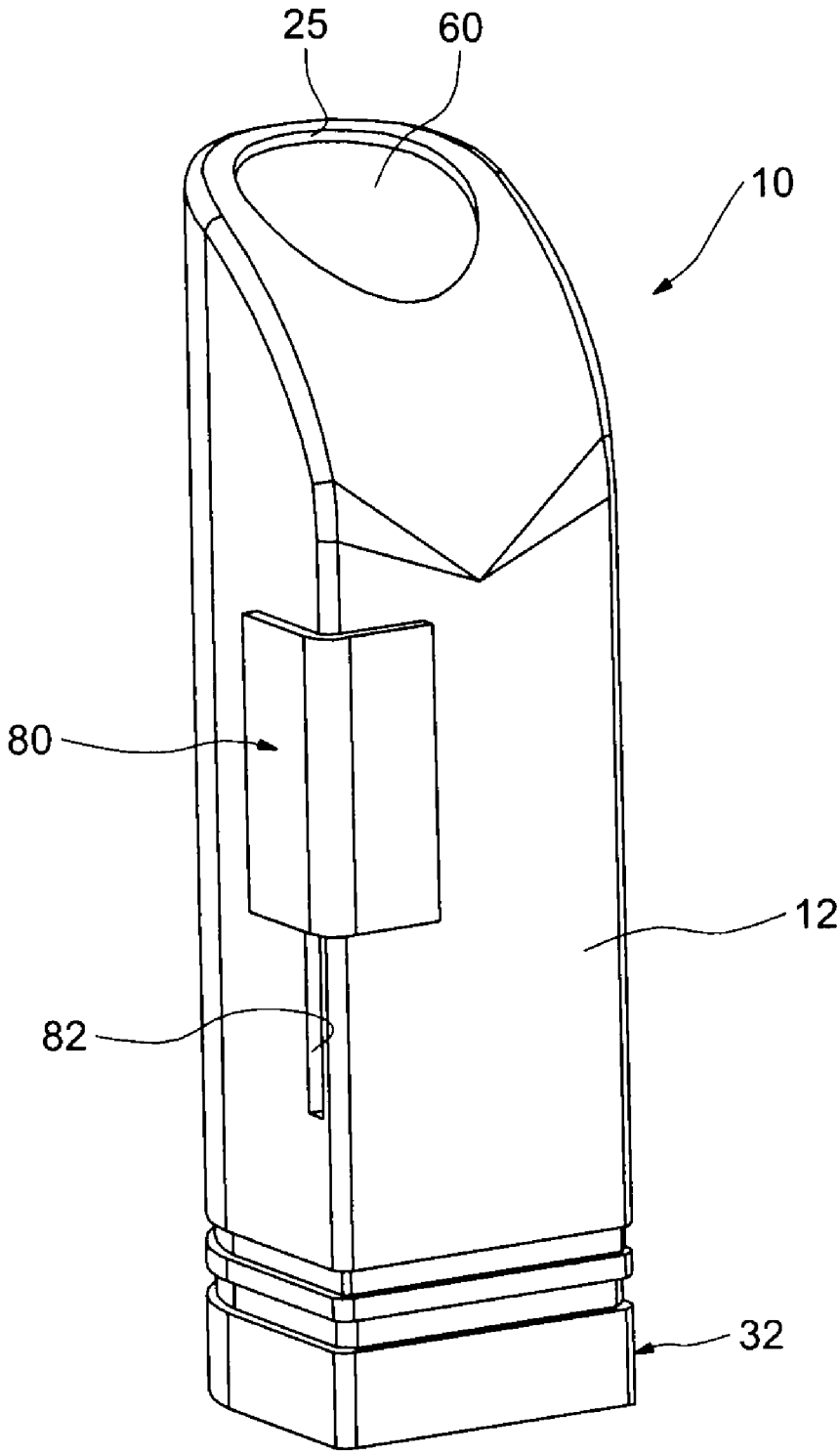
FIG. 1 is a view in perspective of one example of a device for packaging and delivering a product according to a first embodiment of the invention in a position of storage of the product.

Referring now to the drawings, like reference numerals are utilized to designate identical or corresponding parts throughout the several views.

FIGS. 1 to 7 represent a device indicated by the general reference number 10, designed to be used for the packaging and delivery of a stick S or quantity of a product, in one example, a cosmetic product.

The stick S may for example be a lipstick or a lip care product. However, the device 10 also applies to the packaging and delivery of other types of products, for example a foundation, an eyeshadow, a face powder, a color corrector, a treatment, washing or moisturizing compound, a deodorant, or else a haircare product. The device 10 is represented in the figures in a position that is assumed to be vertical.

As will be described in detail hereinafter, the device 10 is notably suitable for allowing a movement of the stick S in a particularly secure manner, with reduced risk of damaging the cosmetic product.

Figure 2:
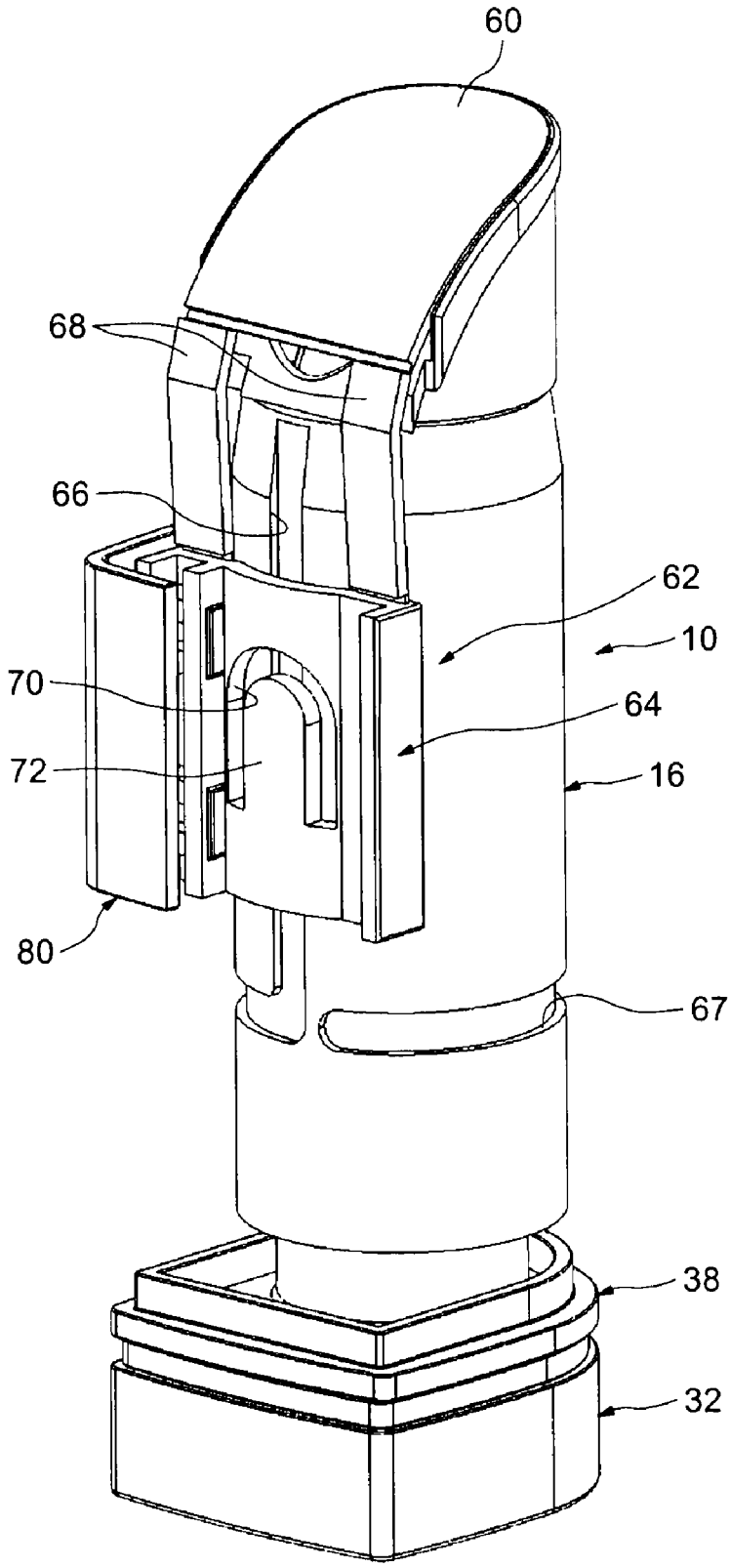
FIG. 2 is a partial view in perspective of the device of FIG. 1.
Figure 3:
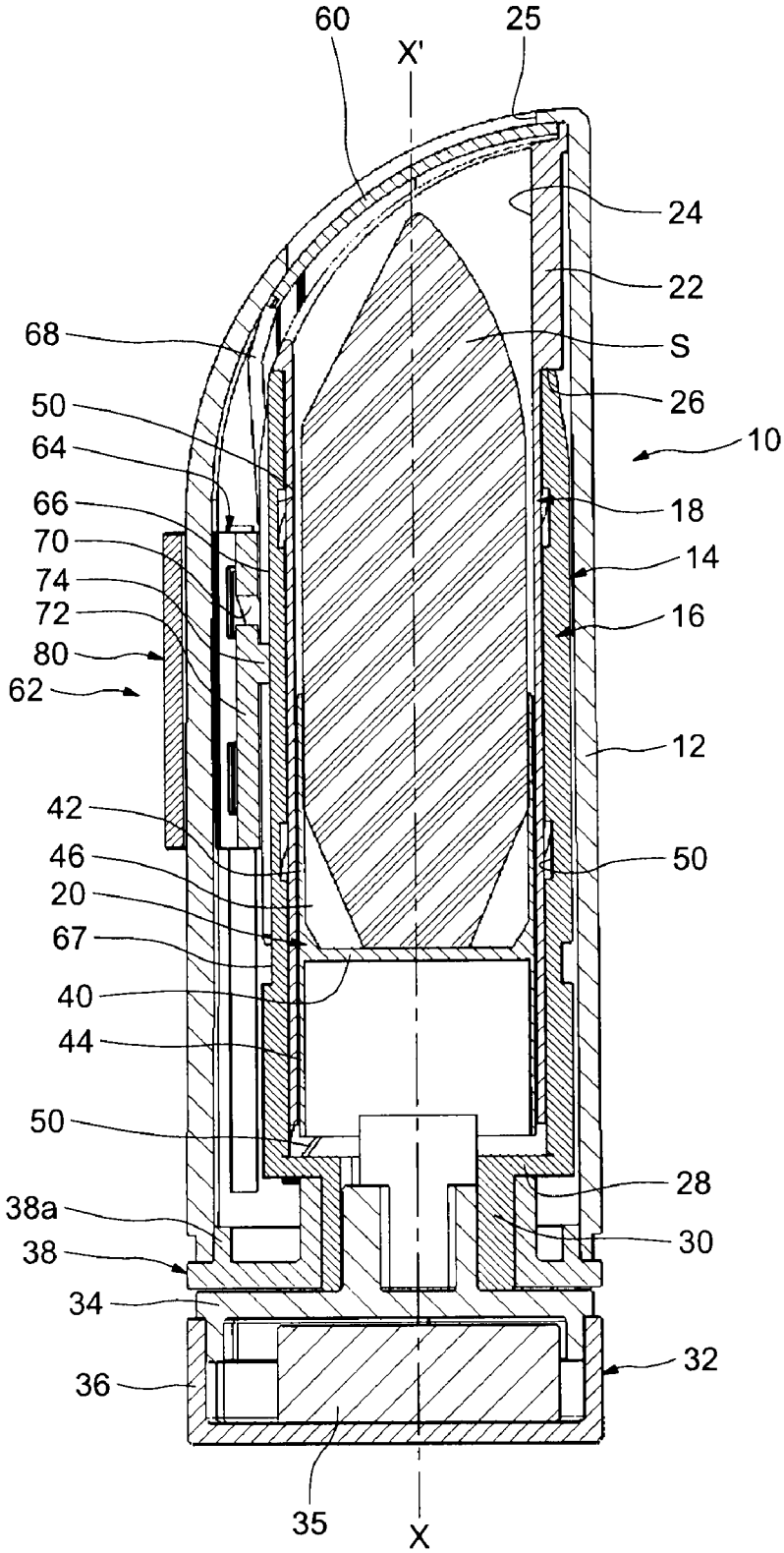
FIG. 3 is a view in section of the device of FIG. 1.
Figure 4:
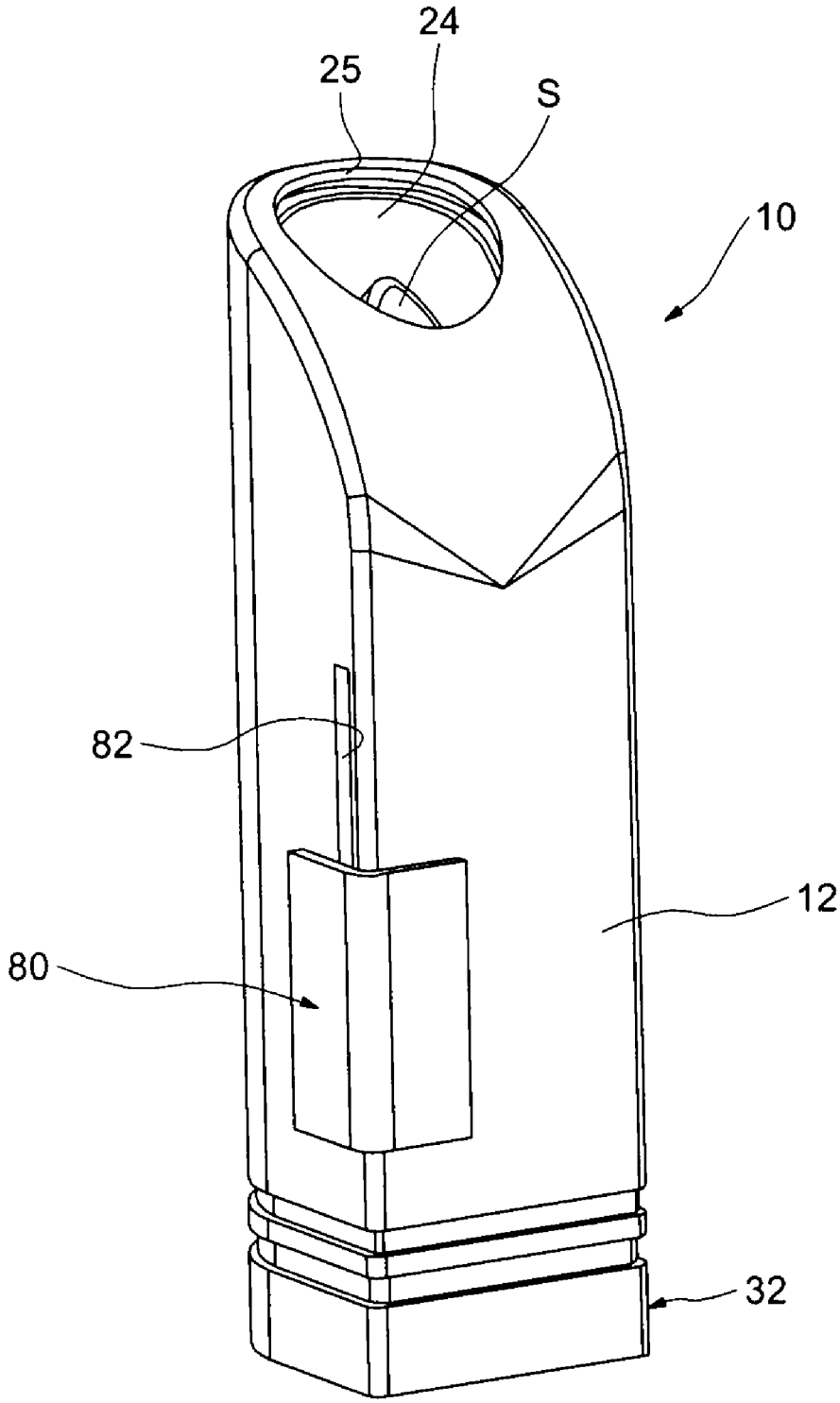
FIG. 4 is a view in perspective of the device of FIG. 1 after movement of a closure means.
Figure 5:
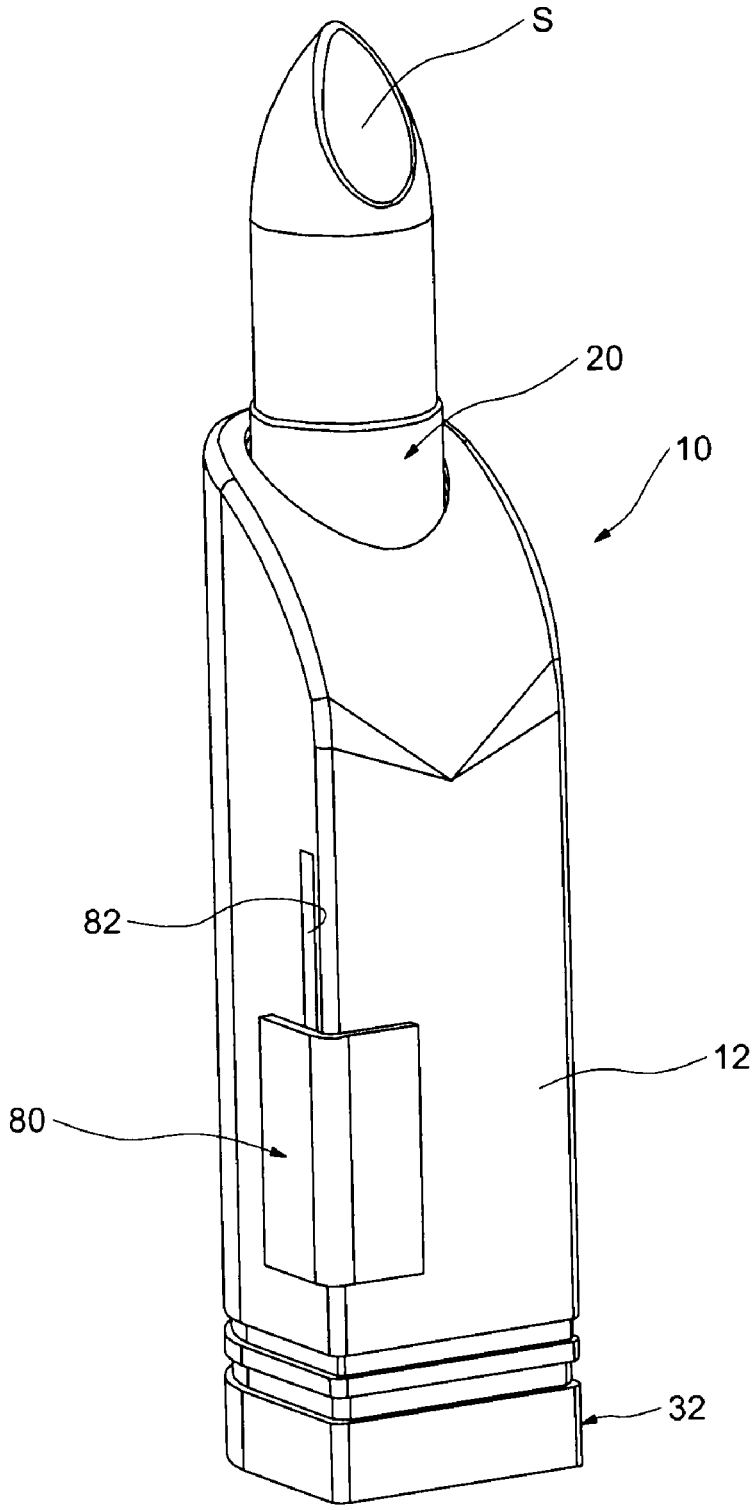
FIG. 5 is a view in perspective of the device of FIG. 1 after the product has been moved to a position of use.
Figure 6:
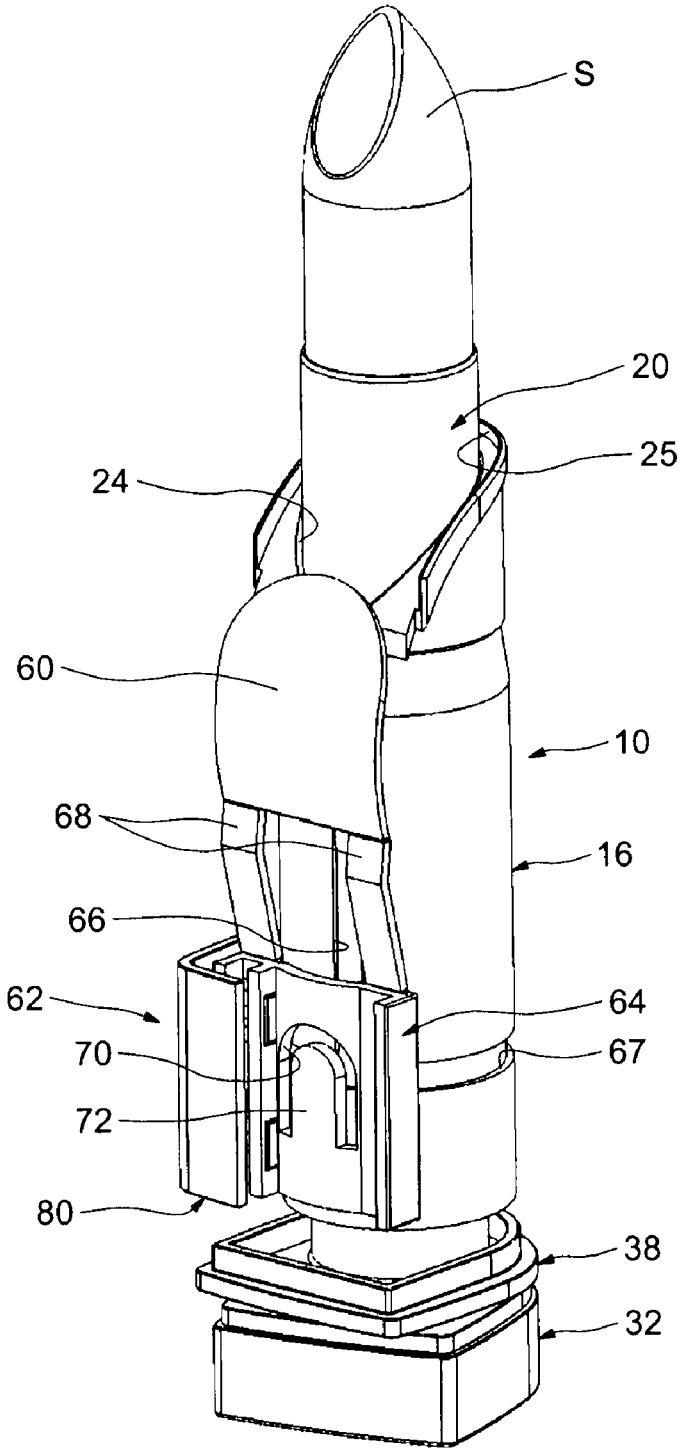
FIGS. 6 and 7 are respectively views in partial perspective and in section of the device in the position of use of FIG. 5.
Figure 7:
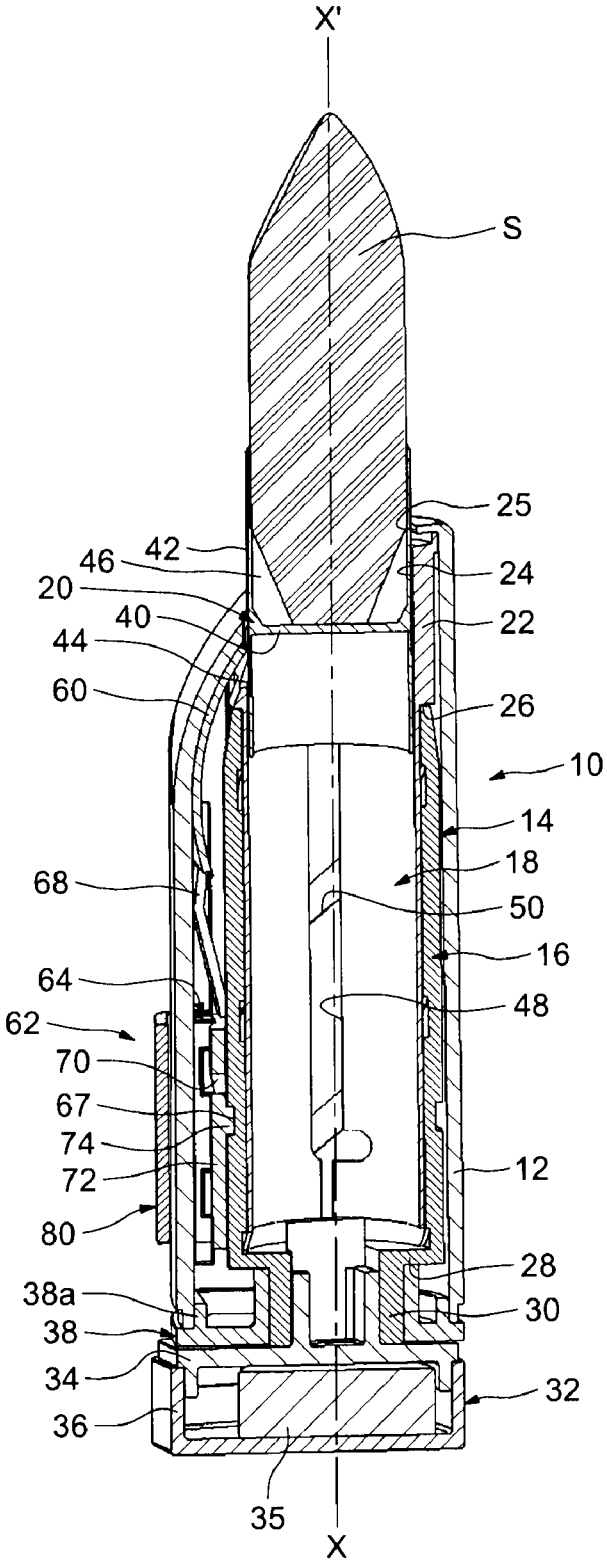
Figure 8:
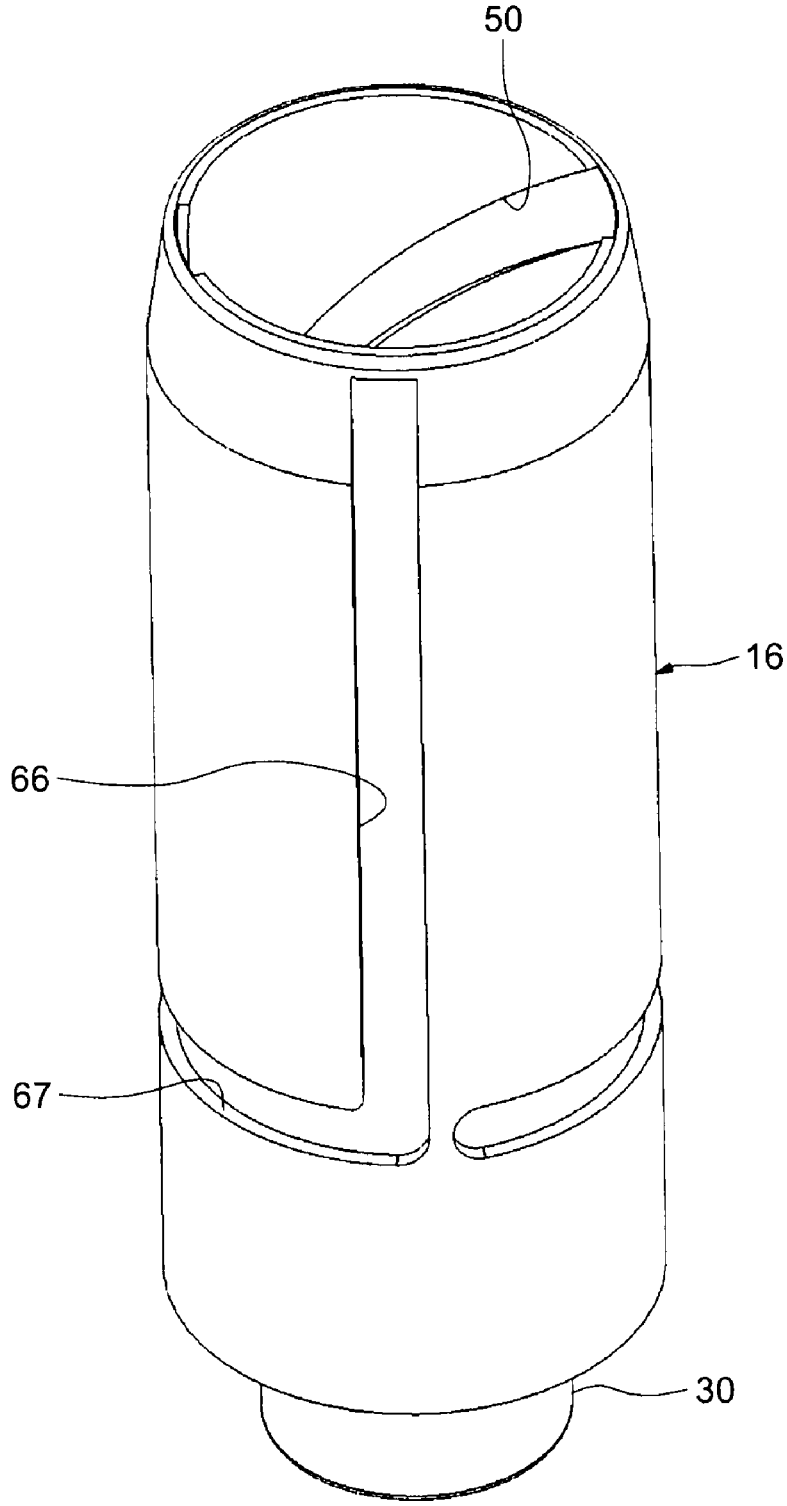
FIG. 8 is a view in perspective of a casing that operates a cup that supports the product of the device of FIG. 1.

The device 10 comprises a body 12 and an operating mechanism 14 to allow the stick S to pass from a storage position illustrated in FIGS. 1 to 3 to at least one position of use illustrated in FIGS. 5 to 7.

The operating mechanism 14 typically comprises a casing 16 or outer sleeve, a guidance sheath 18 mounted in the casing 16, and a cup 20 for supporting the stick S mounted slidingly inside the sheath 18. The guidance sheath 18 typically extends along a vertical axis X-X' and comprises, at a top end, a head 22 delimiting an outlet orifice 24 for the stick S. The head 22 arranges a radial annular bearing surface 26 for the casing 16. The axis X-X' of the guidance sheath 18 is in this instance secant to the outlet orifice 24 and more particularly orthogonal to the latter. In this embodiment, the axis X-X' secant to the opening forms the longitudinal axis of the casing 16 of the guidance sheath 18 and of the supporting cup 20.

In the depicted example, the casing 16 is of generally tubular shape and radially surrounds the guidance sheath 18. The casing includes, at a bottom end, a radial portion 28 extending toward the inside which is extended from a small-diameter edge by an axial skirt 30 closed off by an operating member 32. The body 12, the casing 16, the guidance sheath 18 may advantageously be made of a thermoplastic material, for example methyl acetate (POM) or else polyamide (PA).

The operating member 32 is secured to the casing 16 and suitable for rotating said casing. It is provided with a first endpiece 34 attached to the inside of the skirt 30 of the casing 16, and a second endpiece 36 fitted to the first endpiece by any appropriate means, for example by snap fitting. It is also possible to provide an axial attachment by snap fitting between the skirt 30 of the casing 16 and the first endpiece 34. The angular attachment between these two elements is obtained by complementarity of shape. In the depicted example, between a bottom wall (not referenced) of the second endpiece 36 and the first endpiece 34, a weight 35 is mounted forming a means for ballasting the device 10. The weight 35 is typically centered on the axis X-X'.

The depicted device 10 also comprises a base 38 mounted on the skirt 30 of the casing 16 and situated axially between the radial portion 28 and the first endpiece 34. The base 38, typically of generally annular shape, comprises, in the vicinity of its periphery, a collar 38*a* extending axially in the direction of the radial portion 28. The collar 38*a* matches in shape with a bottom end of the body 12 so as to allow the latter to be mounted onto the base 38. The axial connection between the latter and the body 12 is made by any appropriate means. The body 12 surrounds the casing 16 and the sheath 18. At its top end, the body 12 rests on the head 22 of the sheath and delimits an opening 25 for the outlet of the stick S. The opening 25 is offset axially upward relative to the outlet orifice 24.

To allow the stick S to pass from a retracted or storage position inside the body 12 to a position of protrusion or of use in which the stick S protrudes at least partially relative to the body and to the head 22 of the sheath 18, the supporting cup 20 is used. The cup 20, centered on the axis X-X', is provided with a bottom wall 40 extended axially from a large-diameter edge by an annular portion 42 extending axially in the direction of the outlet orifice 24 and designed to receive the stick S. The annular portion 42 extends beyond the bottom wall 40 and forms a skirt 44 extending axially in the direction of the radial portion 28. The skirt 44 allows good guidance of the cup inside the casing 16 when it is moved. The skirt 44 and the portion 42 are radially in contact against said casing.

To achieve the positioning and retention of the stick S inside the annular portion 42, the cup 20 comprises ribs 46 arranged at the bore of said portion and directed radially inward. The ribs 46, can be provided in various numbers, for example, six, are distributed evenly over the circumference of the annular portion 42. The radial dimension of the ribs 46 progressively increases while moving toward the bottom wall 40 in order to allow the stick S to be positioned by jamming inside the cup 20. The cup 20 therefore forms a seat for the stick S.

In order to expel the air that may be trapped between the bottom wall 40 and the stick S when it is installed, the supporting cup 20 may comprise at least one vent (not visible) arranged on the bottom wall 40.

The supporting cup 20 typically comprises lugs (not visible) mounted inside diametrically opposed longitudinal slots 48 which are arranged on the guidance sheath 18. The lugs are also dimensioned so as to have a sufficient radial dimension for each, after passing through the slots 48, to enter a respective helical groove 50 made on the inner surface of the casing 16, so that a rotation of the operating member 32 may be accompanied, in certain operating circumstances, by an axial movement of the cup 20 relative to the casing 16 and the sheath 18 in the direction of the outlet orifice 24.

To allow the outlet orifice 24 to be closed off when the stick S is in the storage position, the device 10 typically comprises a closure flap 60 which is connected to an actuator 62 for actuation of said flap. The flap 60 forms a closure means allowing the passage from a closed position of the outlet orifice 24 to an open position, and vice versa.

In order to move the stick S without damage from the storage position inside the body 12 to the position of use, the device 10 is designed to allow the axial movement of said stick only when the closure flap 60 leaves the outlet orifice 24 free.

Accordingly, the actuator 62 notably comprises a slide 64 interacting, by means of a lug 74, with one of the grooves 66, 67 made on the outer surface of the casing 16. As will be described in greater detail below, the longitudinal groove 66 extends axially downward from the immediate vicinity of a free top edge of the casing 16 against which the head 22 delimiting the outlet orifice 24 is resting, and is extended by the groove 67 which extends circumferentially over the outer surface of the casing 16, axially on the side of the operating member 32. The angle formed between the longitudinal groove 66 and the circumferential groove 67 is typically approximately 90°; it is for example between 90° and 95°.

The slide 64 is connected to the closure flap 60 by two claws 68 which are for example flexible. As variants, the claws 68 may be rotatably articulated by means of fitted articulation spindles. The slide 64 is housed inside the body 12 and comprises an opening or notch 70 that is generally C-shaped delimiting a flexible tongue 72. The tongue 72 comprises the lug 74 housed inside the groove 66 of the casing 16 and forming a means for guiding the actuator 62 along said casing along the axis X-X', as will be described in greater detail below.

Figure 9:
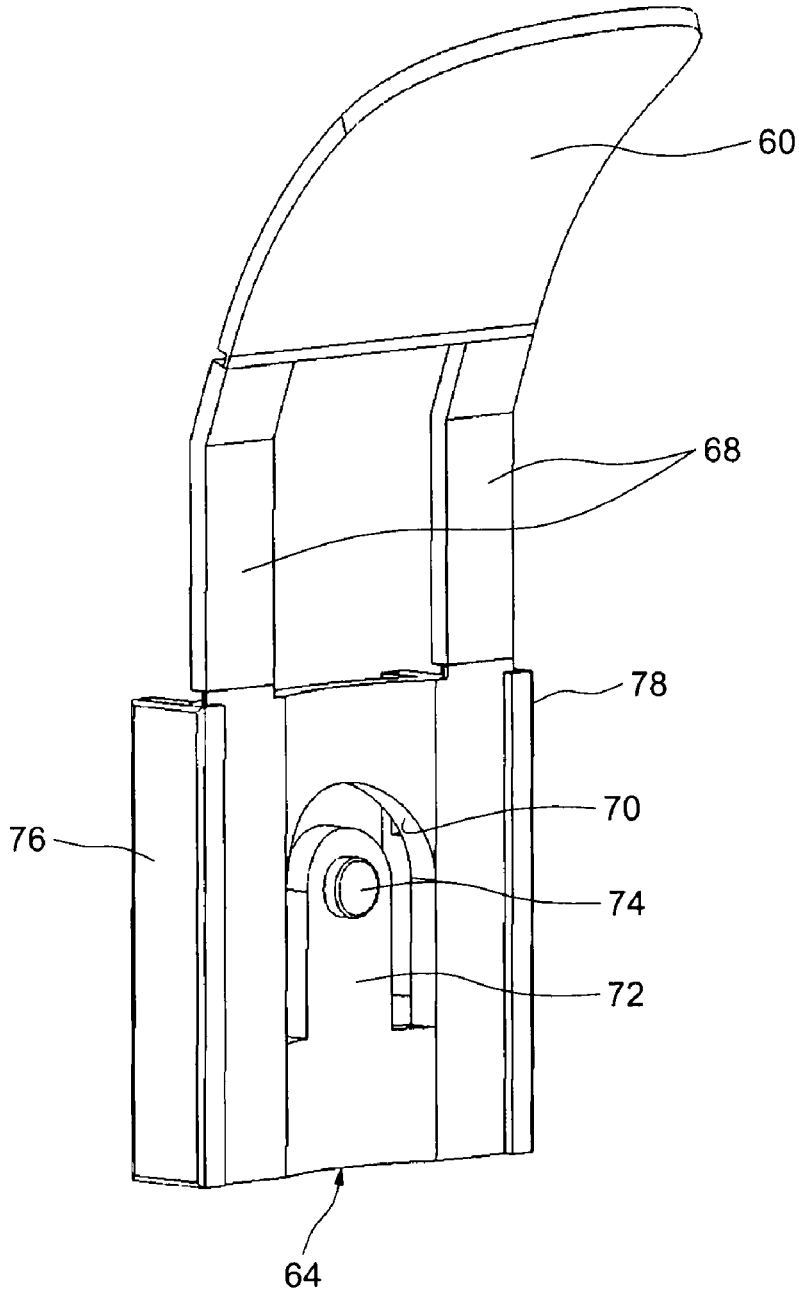
FIGS. 9 and 10 are views in perspective of a slide and closure flap for closing off an orifice for the outlet of the product of the device of FIG. 1.
Figure 10:
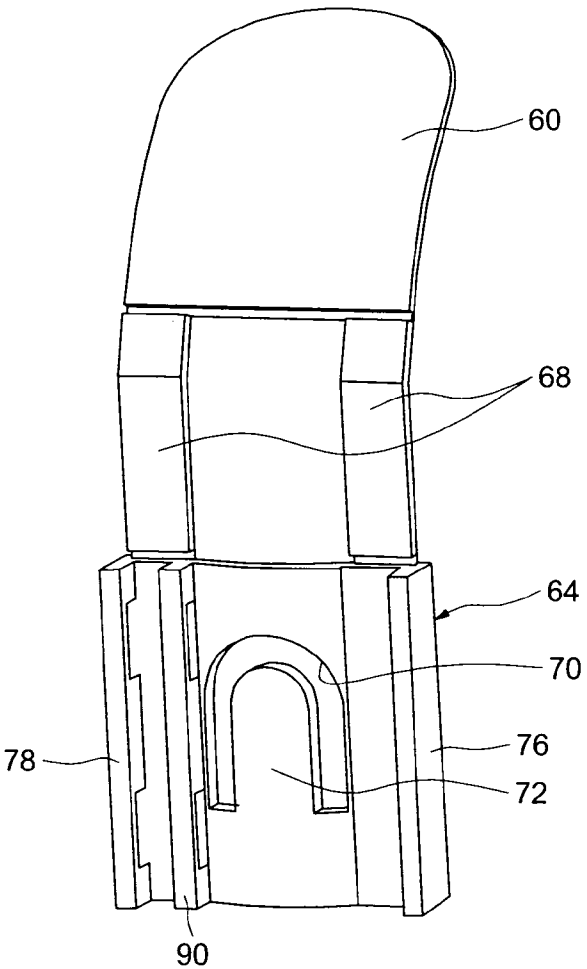

As illustrated more visibly in FIGS. 9 and 10, the slide 64 comprises, at each lateral end, guidance flanges 76, 78 inside the body 12. These flanges 76, 78 match the shape of the body 12.

In order to be able to control the movement of the slide 64, the actuator 62 comprises a button 80 that can be accessed from the outside of the body 12. The button, partially matching the shape of the body 12, in this instance is, in cross section, generally L-shaped. The body 12 comprises a polygonal cross section. The button 80 extends pressing against two faces of the polygon. The body 12 associated with the button provided for the actuation of a closure flap may be considered independently of the design of the casing 16, and of the associated antirotation means.

Figure 11:
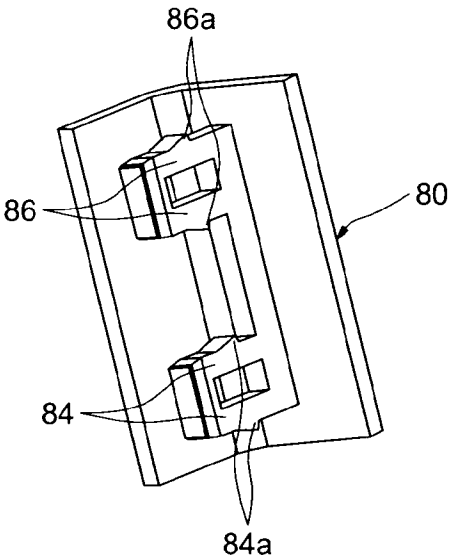
FIG. 11 is a view in perspective of the slide of FIGS. 9 and 10.

A slot or opening 82, for example longitudinal, is made on a side wall of the body 12 so as to allow the attachment of the button 80 to the slide 64 housed inside said body. Accordingly, the button 80 comprises two sets of two claws 84, 86 (FIG. 11), the claws of one and the same set being connected together. The claws 84, 86 each comprise a hook 84*a*, 86*a*, respectively to allow coupling to the slide 64. For this purpose, openings (not referenced) are provided on the guidance flange 78 to allow the hooks 84*a*, 86*a* to pass and be coupled to said flange, the free end of the claws 84 and 86 being housed inside openings arranged on a rib 90 of the slide 64 extending vertically along the latter and situated in the vicinity of the notch 70. The button 80, the slide 64 and the closure flap 60 are therefore connected together so as to move jointly.

As indicated above, the lug 74 forming a means for guiding the actuator 62 is housed in one of the grooves 66, 67 arranged on the outer surface of the casing 16. The lug 74 in this instance is of generally cylindrical shape. Naturally, it can also be envisaged to provide a lug of a general shape that is substantially different, having for example a cross section that is not axisymmetrical—for example a polygonal cross section.

The first groove 66 extends axially, from the immediate vicinity of the top free edge of the casing 16, to the bottom along the axis X-X' over the major portion of the latter. The axial dimension of the longitudinal groove 66 is suited to allowing the closure flap 60 to pass from the closed position of the outlet orifice 24 to the open position in which it leaves said orifice entirely free.

The use of the groove 66 extending axially, parallel to the axis X-X', over the outer surface of the casing 16 makes it possible to prevent the casing 16 from rotating, even if the user tries to actuate the operating member 32. Specifically, the lug 74 and the first groove 66 form means for preventing the rotation of the casing 16 and of the operating member 32. Therefore, even if the user wishes to obtain the axial movement of the stick S to the position of use, the interaction of the longitudinal groove 66 and the lug 74 prevents this movement until the closure flap 60 leaves the outlet orifice 24 appropriately open.

Once the closure flap 60 leaves said orifice 24 appropriately open, and preferably entirely open, the lug 74 of the actuator 62 is situated at the bottom end of the first groove 66. This bottom end is connected to the second groove 67 which extends circumferentially over the outer surface of the casing 16. In this position, if the user actuates the operating member 32, he may now have the stick S rise to the position of use by the rotation of the casing 16 relative to the lug 74. The circumferential dimension of the groove 67 is adapted according to the desired axial movement of the supporting cup 20 between the storage position and the position of use. In this embodiment, the axial movement is of the order of 38 mm. Accordingly, the second groove 67 typically extends in an angular range from 345° to 355°, and is preferably 350°. The second groove 67 forms a means for guiding in rotation the actuator 62, and more precisely the lug 74.

Therefore, with the device 10, in order to allow the stick S to pass from the storage position to the position of use, it is necessary initially to move the closure flap 60 by sliding the lug 74 inside the first groove 66 until it comes to be housed in the zone of the second groove 67 which is directly connected to the first groove 66, which makes it possible then to rotate the operating member 32 and the casing 16, ensuring the axial rising of the stick S.

In a similar manner, after the use of the stick S, the movement of the closure flap 60 from the open position of the outlet orifice 24 to the closed position is made possible only when the lug 74 is situated at the bottom end of the groove 66 which is connected to the groove 67, which prevents any damage to the stick S by the flap 60. To move the stick S from the position of use to the storage position, the user initially actuates the operating member 32 so as to allow the lug 74 to rotate inside the second groove 67 until it butts against the end of the groove 67, then, when the stick has reached the storage position, he may move the closure flap 60 so as to cover the outlet orifice 24.

Figure 12:
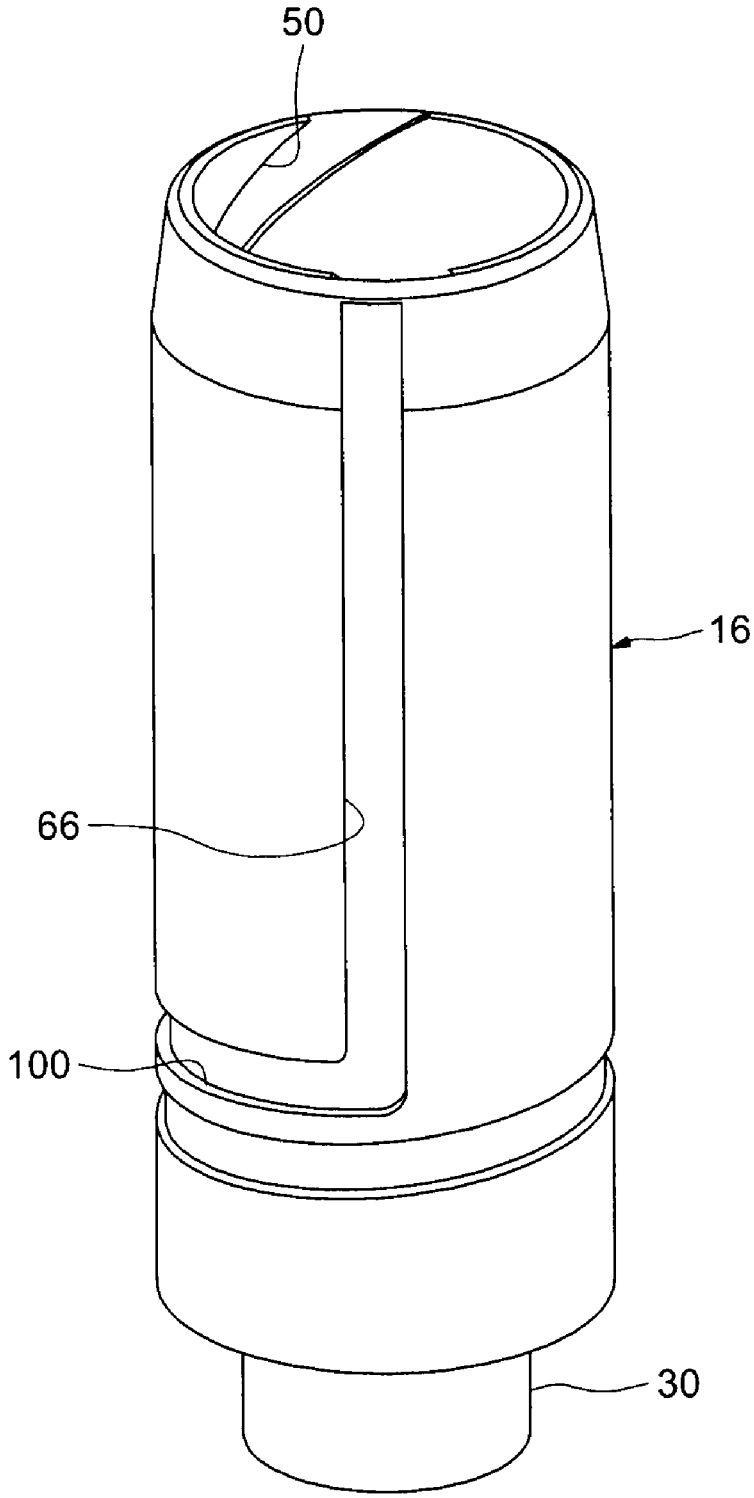
FIG. 12 is a view in perspective of a casing that moves the cup that supports the product of a device according to a second embodiment of the invention.

As mentioned above, in this embodiment, the groove 67 makes it possible to obtain an axial movement of the stick S of approximately 38 mm. The circumferential dimension of this groove 67 may be adapted according to the value chosen for the movement of the stick S. If it is desired to maintain the pitch usually used in the packaging devices for lipstick, which is usually of the order of 33 mm, it is possible, as is illustrated in the variant embodiment of FIG. 12 in which the identical elements carry the same reference numbers, to provide a second, helical groove 100 which extends in a helical manner, about the axis X-X', over the outer surface of the casing 26 in the direction of the skirt 30. To obtain such an axial movement of the stick S, the second groove 100 may extend over an angular range of between 560° and 570°. The angle formed between the longitudinal groove 66 and the helical groove 100 is advantageously between 90° and 95°.

In the embodiments previously described, the slide 64, the claws 68 and the closure flap 60 are obtained in a single piece, by molding of a plastic such as methyl acetate (POM) or else polyamide (PA). This produces a low-cost part. In addition, junction zones of smaller section may therefore be easily provided on the one hand between the claws 68 and the slide 64, and on the other hand between said claws and the closure flap 60 so as to promote the deformation of the claws during the passage from the closed position of the outlet orifice 24 to the open position. Furthermore, because of the flexibility of the tongue 72, the lug 74 is housed inside the grooves 66, 67 with a permanent stress, which helps to keep it in position.

Figure 13:
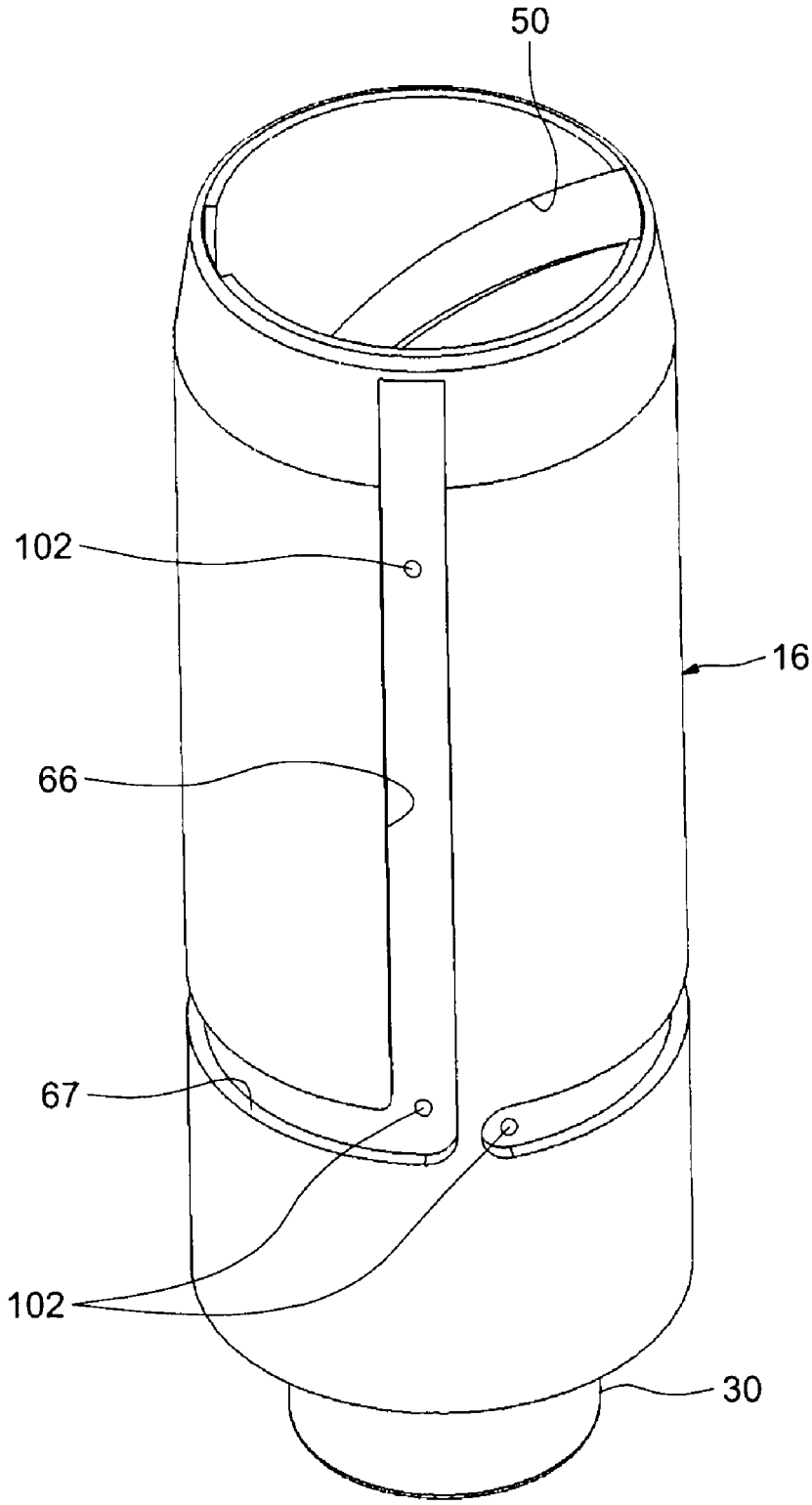
FIG. 13 is a view in perspective of a casing that moves the cup that supports the product of a device according to a third embodiment of the invention.

In the embodiments previously described, the grooves 66 and 67 are delimited respectively in the longitudinal and circumferential direction by lateral edges that are parallel with one another and substantially smooth, connected together by a bottom or web. As a variant, as illustrated in FIG. 13, a nick 102 for example in the shape of a grain of rice or a boss may be made, in the bottom position of the actuator 62, in the bottom of the groove 67 at the portion of the groove corresponding to an out position, in particular at the maximum position, of the product and/or in the zone of connection with the groove 66, and/or in the groove 66 in the top position of the actuator 62 at a height corresponding to the closure of the outlet orifice 24. As a variant, or additionally, it is possible to provide opposite protrusions or protuberances on the edges of the groove 66 and/or 67 in order to allow the closure flap 60 to be locked in the open position of the outlet orifice 24 and/or in the closed position.

As evident from the examples discussed above, the embodiments of the invention provide a device in which the stick S of product may be moved between a position of use and a storage position while reducing the risk of the stick S making contact with the closure flap, and to do so by providing two separate and successive movements for the raising and lowering of the stick S and the movement of the flap.

Although, in the embodiments described, the device 10 comprises a closure flap 60 to cover the orifice 24 for the outlet of the product, it is possible, without departing from the scope of the invention, to provide a closure cap snap fitting onto the body 12, instead of this flap or in addition. In these circumstances, the actuator 62 makes it possible to move the lug 74 in the groove 66 to prevent the casing 16 and the operating member 32 from rotating. The lug 74 and the groove 66 still provide axial locking of the position of the supporting cup 20 and of the stick S in a given position.

In other words, the bottom position of the actuator 62 corresponds to a position allowing the delivery of the stick S and the top position of the actuator corresponds to a position of preventing delivery of the stick S and optionally of closing off the outlet orifice 24.

In another variant embodiment, additional longitudinal grooves circumferentially spaced relative to the first groove 66 and connecting to the second groove 67 are provided on the outer surface of the casing 16 so as to allow the supporting cup 20 to be locked in position in a plurality of positions of use of the stick S. Depending on the angular positions of the additional longitudinal grooves, the user obtains a smaller or larger outlet of the stick S. Therefore, there is a plurality of stable positions of use which correspond to different heights by which the stick S protrudes.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and delivering a product, the device comprising:

a body;

a supporting cup that provides a seat for the product and that moves relative to the body between a storage position and at least one position of use of the product;

means for operating the supporting cup, the means including a guidance sheath, a casing surrounding said guidance sheath and an operating member that rotates said casing in order to obtain the axial movement of the supporting cup inside the guidance sheath, the device further including antirotation means for preventing the rotation of the casing, wherein the antirotation means interacts with said casing and with a means for actuating the antirotation means, and wherein at least a portion of the antirotation means is provided on an outer surface of the casing, wherein the means for actuating is configured to move relative to the body, wherein the antirotation means is configured to prevent the means for actuating from rotating relative to the body, and wherein the means for actuating is separate from the operating member.

2. The device according to claim 1, wherein the antirotation means are secured to the casing in the storage position and in the position of use of the product.

3. The device according to claim 1, wherein the antirotation means are arranged at least partly on the outer surface of the casing.

4. The device according to claim 1, wherein the antirotation means guide the actuation means along at least two paths of different direction.

5. The device according to claim 1, wherein the antirotation means guide the actuation means along at least one translation path.

6. The device according to claim 5, wherein the translation path extends along an axis parallel to an axis secant to an orifice for the outlet of the product.

7. The device according to claim 1, further comprising means for guiding the actuation means along at least one rotation path.

8. The device according to claim 1, wherein the antirotation means comprise at least a first groove extending axially along the outer surface of the casing and a lug that interacts with the first groove in order to prevent the casing from rotating.

9. The device according to claim 8, wherein the casing comprises a second groove connecting to the first groove and extending over the outer surface of the casing about the axis, said second groove being capable of allowing the casing to rotate relative to the lug.

10. The device according to claim 9, wherein the second groove extends circumferentially over the outer surface of the casing in an angular range from 345° to 355°, and preferably equal to 350°.

11. The device according to claim 9, wherein the second groove extends helically over the outer surface of the casing.

12. The device according to claim 1, further comprising means for closing off an orifice for the outlet of the product that can be moved between a position of closure of the outlet orifice and an open position.

13. The device according to claim 12, wherein the closure means is secured to the actuation means.

14. The device according to claim 12, wherein the antirotation means allowing the closure means to be guided between the closed position of the outlet orifice and the open position.

15. The device according to claim 1, wherein the actuation means comprises a slide provided with a flexible tongue on which the antirotation means are partly provided.

16. The device according to claim 15, wherein the actuation means comprises a button that can be accessed from the outside of the body and that is furnished with attachment means capable of allowing the button to be mounted on the slide.

17. The device according to claim 16, wherein the body comprises a polygonal transverse section, the button extending at least partly over two faces of the polygon.

18. The device according to claim 1, wherein the operating member can be accessed permanently in the storage position and in the position of use of the product.

19. The device according to claim 1, wherein the product is a cosmetic product.

20. The device according to claim 1, wherein the product is lipstick.

21. A makeup method comprising:

applying a cosmetic product mounted on a supporting cup that can be moved in a casing by an operating member between a storage position and at least one position of use; and locking movement of the cup in the position or positions of use by an antirotation device controlled by an actuating means for preventing the casing from rotating, wherein the means for actuating is configured to move relative to the casing, wherein locking movement of the cup also prevents the actuating means from rotating relative to the casing, wherein the actuating means is separate from the operating member, and wherein the antirotation device interacts with said casing and with the actuating means, and wherein at least a portion of the antirotation device is provided on an outer surface of the casing.

22. The method according to claim 21, wherein the movement of the cup from the storage position to the position or positions of use is permitted only after a means for closure of an orifice for the outlet of the cosmetic product has been moved to leave said outlet orifice open.

23. A device for packaging and delivering a product, the device comprising:

a body;

a supporting cup that provides a seat for the product and that moves relative to the body between a storage position and at least one position of use of the product;

an operating member that moves the supporting cup, the operating member including a guidance sheath, a casing surrounding said guidance sheath and an operating member that rotates the casing in order to obtain movement of the supporting cup inside the guidance sheath along an axis of the body, the device further including a first groove extending axially along an outer surface of the casing and a lug that travels along the first groove and blocks rotation of the casing while the lug is disposed within the first groove and a slide on which the lug is disposed, the slide being movable relative to the body in a direction along the axis of the body, wherein the lug positioned along the first groove is configured to prevent the slide from rotating relative to the body, and wherein the slide is separate from the operating member.

24. The device according to claim 23, further comprising a second groove disposed on the outer surface of the casing and extending at least partially around a circumference of the casing, wherein the second groove intersects the first groove, and the lug travels from the first groove to the second groove to allow rotation of the casing.

* * * * *